US007311425B2

(12) United States Patent
Jervey, III

(10) Patent No.: US 7,311,425 B2
(45) Date of Patent: Dec. 25, 2007

(54) RETROFIT PENDANT LIGHT FIXTURE

(76) Inventor: Edward Darrell Jervey, III, 302 Hollyport Rd., Richmond, VA (US) 23229

( * ) Notice: Subject to any disclaimer, the term of this patent is extended or adjusted under 35 U.S.C. 154(b) by 97 days.

(21) Appl. No.: 11/295,872

(22) Filed: Dec. 7, 2005

(65) Prior Publication Data

US 2007/0127234 A1 Jun. 7, 2007

(51) Int. Cl.
*F21V 21/16* (2006.01)

(52) U.S. Cl. ..... 362/407; 362/391; 362/403; 362/406; 362/650

(58) Field of Classification Search ..... 362/147, 362/403–408, 650, 391
See application file for complete search history.

(56) References Cited

U.S. PATENT DOCUMENTS

| | | | | |
|---|---|---|---|---|
| 4,232,361 | A | 11/1980 | Kelsall | |
| 4,595,969 | A | 6/1986 | McNair | |
| 4,952,157 | A | 8/1990 | Hudson et al. | |
| 6,679,620 | B2 * | 1/2004 | Patz et al. | 362/308 |
| 7,153,167 | B1 | 12/2006 | Switzer | |
| 2007/0014118 | A1 * | 1/2007 | Shourds | 362/407 |

* cited by examiner

*Primary Examiner*—Sandra O'Shea
*Assistant Examiner*—Jason Moon Han
(74) *Attorney, Agent, or Firm*—Dority & Manning, P.A.

(57) ABSTRACT

A retrofit pendant light fixture that is adapted to be hung from a ceiling and readily installed in a socket normally carried within a recessed housing in the ceiling. A lamp is carried on a lower end of an electrical cord extending from an adapter housing.

8 Claims, 3 Drawing Sheets

RETROFIT PENDANT LIGHT FIXTURE

BACKGROUND OF THE INVENTION

It has been common to provide lighting within recessed cylinders in the ceilings of houses and buildings which generally restricts the choice of light being emitted from a bulb to be more diffused and ambient in nature. These lighting fixtures are normally carried within a cylinder that is mounted in a ceiling. Often times it is desired that in certain areas of a room the light be allowed to focus on certain areas or highlight certain object more than if the bulb is mounted within a recess cylinder.

OBJECTS AND SUMMARY OF THE INVENTION

Accordingly, an object of this invention is to provide a pendant light fixture that can be readily installed in a recessed socket carried within a cylinder.

Another important object of the present invention is to provide a pendant light fixture that can be readily installed to convert a light fixture having a socket recessed within a cylinder to a hanging light fixture.

Still another object of the present invention is to provide a pendant light fixture which can be readily mounted in a socket provided in the ceiling and the length of the pendant light can be readily adjusted either permanently or temporarily.

The above objects and advantages can be accomplished according to the present invention which is directed to a retrofit pendant light fixture. The pendant light fixture includes an adapter housing having an upper end and a lower end. Threads are carried on the upper end of the housing so that the housing can be screwed into a conventional socket carried within a ceiling or the like. An elongated electrical wire extends from the housing and through a length adjusting mechanism. A light bulb socket is electrically attached to a lower end of the elongated electrical wire and the distance that the light socket is positioned below the ceiling can be adjusted by the length adjusting mechanism.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention. It is to be understood that what is disclosed in the drawings is a preferred embodiment and it is anticipated that modifications and changes to the preferred embodiment may be made without departing from the scope of the claims of this invention.

DETAILED DESCRIPTION OF THE PREFERRED EMBODIMENTS

Figure 1:
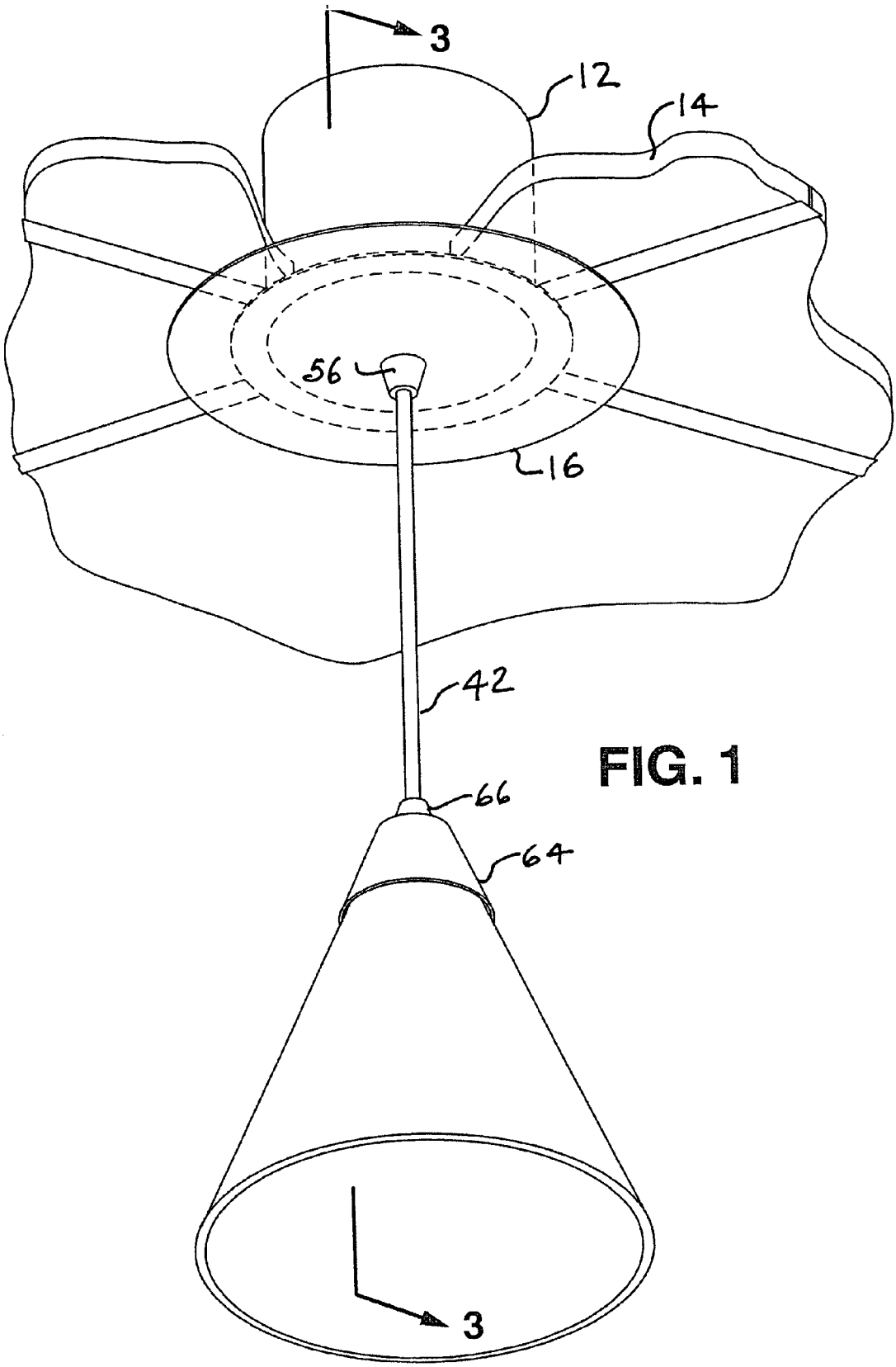
FIG. 1 is a perspective view illustrating a pendant light attached to a recessed cylinder in a ceiling.
Figure 2:
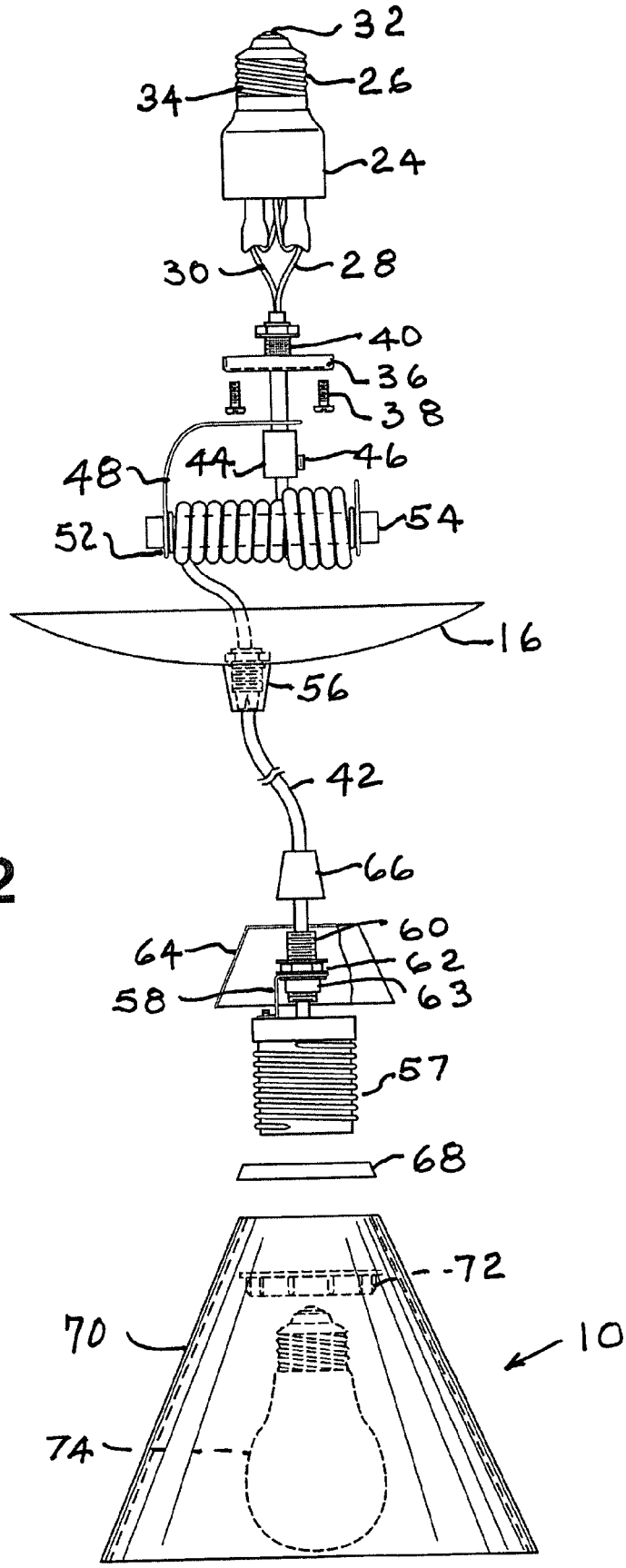
FIG. 2 is a side elevation exploded view of the pendant light with parts being shown in section for purpose of clarity.

Reference now will be made in detail to the presently preferred embodiments of the invention, one or more examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

A presently preferred embodiment of the pendant lamp is shown in the Figures and is represented generally by the numeral 10. The pendant lamp 10 includes an adapter housing 24 that is mounted within a cylindrical cylinder 12 carried within the ceiling of a building. A canopy cover 16 extends over the open end of the cylinder 12 to cover the cylinder. An electrical cord extends from electrical connectors carried within the adapter housing down to a lamp fixture 10.

The pendant light is adapted to be screwed into a female socket 22 carried within the recess cylinder 12. The socket 22 is a conventional socket that is provided for receiving a conventional light bulb. The socket of course is electrically connected to power within the building so that when a light bulb is screwed into the socket, power is supplied to the bulb. There are other versions of adapters which will fit into other types of female lamp sockets. An example is the "European" twist and lock socket used in other countries.

When installing the pendant light fixture, the conventional light bulb is removed from the socket 22 and the pendant light is screwed into the socket 22. The pendant light includes an adapter 24 that is provided with threads 26 on the upper end thereof. The adapter 24 is a hollowed out housing into which a pair of electrical wires 28 and 30 are electrically connected to respective connectors 32 and 34 provided in the adapter housing. The lower end of the housing is covered by an adapter cap 36 which is secured to the main body of the adapter housing 24 by any suitable means such as screws 38. Extending through the cap 36 is a threaded nipple 40 through which the wires 28 and 30 pass. The wires 28 and 30 are carried within a sheath so that exiting from the nipple 40 is a single sheathed wire 42. In other words, the two individual wires 28 and 30 are carried within the sheath wire 42. Of course, the wires 28 and 30 have insulation provided thereon so that they are electrically insulated from each other.

A threaded nut 44 is threaded on the end of nipple 40 and the wire 42 is fixed to the nut 44 by means of a set screw 46.

Figure 3:
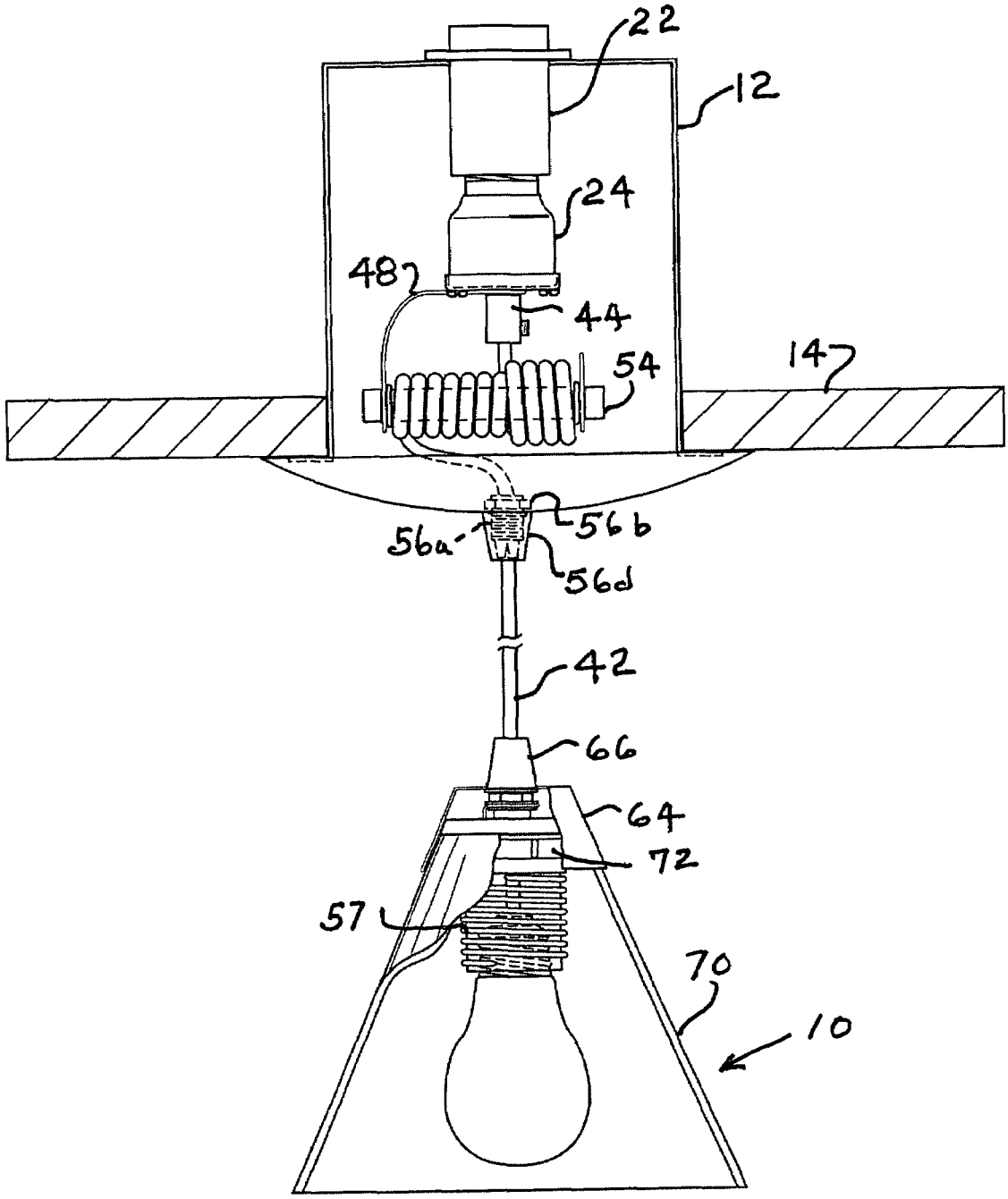
FIG. 3 is a sectional view taken along line 3-3 of FIG. 1.

A slightly flexible bracket 48 is carried on the nipple 40. It has a hole provided in the upper end thereof through which the wire 42 passes. The nut 44 when the device is assembled locks the bracket 48 against the lower side of the cap 36 as best shown in FIG. 3. A lower end 52 of the bracket 48 has a hole provided therein through which a spindle 54 extends. The purpose of the spindle is to adjust the effective length of the cord of the pendant light. By wrapping the cord 42 around the spindle 54 the overall length of the cord extending between the adapter and the socket 57 can be varied at any time.

When the adapter 24 is screwed within the socket 22 as shown in FIG. 3, the canopy cover 16 extends over the open end of the cylindrical housing 12 with the outer edges extending over the hole provided in the ceiling 14. The canopy cover 16 has a hole provided in the center thereof through which the wire 42 passes. An adjustable locking mechanism 56 is carried below the canopy cover so that upon rotating the locking mechanism 56 it becomes fixed to the wire 42 for holding the canopy cover flush against the ceiling 14. Any suitable adjustable locking mechanism could be used for locking the canopy cover to the wire 42 flush against the ceiling 14. The locking mechanism 56 is a conventional locking device and includes a threaded nipple 56*a*. A nut 56*b* is carried on the upper end of the nipple 56. The lower end of the nipple is split so that upon rotating the outer housing 56*d* of the locking mechanism the lower end locks onto the wire 42. The canopy becomes fixed between the housing 56*d* and the nut 56*b*. Connected to the lower end of the wire 42 is a female socket 57 that is electrically connected to the two wires 28 and 30 in a conventional manner. The socket 57 has a bracket 58 fixed to the top thereof that extends around a nipple 60 that has locking nuts 62 and 63 provided thereon. A socket cover 64 is carried on the nipple 60 and is secured to the nipple 60 by means of a threaded nut 66. A shade positioning bevel ring 68 extends around the socket 57 and nests within the socket cover 64 so that when a lamp shade 70 is secured to the socket by a threaded nut 72 it causes the shade to nest against the bevel ring 68 and the socket cover 64 as shown in FIG. 3.

The pendant light can be readily installed in a recess ceiling socket by merely screwing the adapter 24 into a socket which normally receives a light bulb. The length of the pendant light can be varied by winding the cord 42 onto the spindle 54. For example, if it is desired that the light bulb 74 be positioned approximately 3 feet over a counter in a kitchen the effective length of the cord 42 can be adjusted by wrapping the cord around the spindle 54.

In addition to the above improved functions, the pendant light fixture can also provide enhanced visual appeal through fixture decor choices, bulb element choices and placement configurations.

While at least one presently preferred embodiment of the invention has been described using specific terms, such description is for illustrative purposes only, and it is to be understood that changes and variations may be made without departing from the spirit or scope of the following claims.

What is claimed:

1. A pendant light fixture comprising:

an adapter housing having an upper end and a lower end, threads carried on an upper end of said housing, electrical connectors provided on said housing for making electrical connections through said housing when energized, and an elongated electrical wire having an upper end electrically connected to said connectors and a lower end extending out said adapter housing, a length adjusting mechanism, said elongated wire being operatively connected to said length adjusting mechanism for selectively varying the effective length of said wire; and a light bulb socket electrically attached to a lower end of said electrical wire, wherein said wire bearing the weight of said light bulb socket when the fixture is installed in a ceiling.

2. The pendant light fixture as set forth in claim 1 provided for being hung from a recessed socket carried within a ceiling further comprising:

a canopy cover plate carried on said electrical wire for covering said recess socket in said ceiling when said adapter housing is threaded into said recessed socket.

3. The pendant light fixture as set forth in claim 2 further comprising:

an adjustable locking mechanism engaging said wire for adjustably positioning said canopy cover plate on said wire.

4. The pendant light fixture as set forth in claim 1 further comprising:

a lamp shade carried on said wire extending downwardly to cover said light bulb socket.

5. The pendant light fixture as set forth in claim 3 wherein said adjustable locking mechanism includes a compression collar carried on said wire below said canopy cover plate and abutting against said cover plate for holding said canopy cover plate in position on said wire.

6. The pendant light fixture as set forth in claim 1 wherein said length adjusting mechanism includes a spindle around which said elongated electrical wire is wound for adjusting the distance that said light bulb socket hangs below said adapter housing.

7. A pendant light fixture adapted to be screwed into an electrical socket carried in a housing recessed in a ceiling comprising:

an adapter having an upper end and a lower end, threads carried on an upper end of said adapter, an elongated multi-strand electrical wire having an upper end electrically connected to said adapter for making electrical connection with said socket when said adapter is screwed into socket carried in said recessed housing, a light bulb socket, a lower end of said electrical wire being electrically connected to said light bulb socket and;

a canopy carried on said wire and configured to extend over said recessed housing for enclosing said adapter in said housing.

8. The pendant light fixture as set forth in claim 7 further comprising a length adjusting mechanism, said elongated wire being operatively connected to said length adjusting mechanism for varying the effective length of said elongated wire for adjusting the distance that said light bulb socket hangs below said adapter.

* * * * *